United States Patent [19]

Metcalfe et al.

[11] 4,207,040

[45] Jun. 10, 1980

[54] ROTARY ATOMIZATION MEANS FOR THE PRODUCTION OF METAL POWDER

[75] Inventors: Robert A. Metcalfe, West Palm Beach; Romeo G. Bourdeau, Tequesta, both of Fla.

[73] Assignee: United Technologies Corporation, Hartford, Conn.

[21] Appl. No.: 4,101

[22] Filed: Jan. 16, 1979

Related U.S. Application Data

[62] Division of Ser. No. 862,898, Dec. 21, 1977.

[51] Int. Cl.[2] ..... B01J 2/14

[52] U.S. Cl. ..... 425/8; 264/8

[58] Field of Search ..... 425/8; 264/8

[56] References Cited

U.S. PATENT DOCUMENTS

| | | | |
|---|---|---|---|
| 2,062,093 | 11/1936 | Kann | 425/8 |
| 2,699,576 | 1/1955 | Colbry et al. | 425/8 |
| 3,721,511 | 3/1973 | Schlienger | 425/8 |

*Primary Examiner*—Donald J. Arnold
*Assistant Examiner*—James R. Hall
*Attorney, Agent, or Firm*—Robert C. Walker

[57] ABSTRACT

A rotary liquid metal atomizer is positioned to receive a stream of molten metal on the top thereof. The atomizer is formed as a hollow disc means having a concave top surface and mounted for rotation at high R. P. M.'s on the top of a hollow drive shaft. A circular coolant baffle is located in the hollow disc means, for cooling fluid to flow around, and is mounted on the top of an inlet cooling tube located within the drive shaft. Cooling fluid is directed through the inlet cooling tube to the top of the water baffle where it flows through a hole in the center thereof and around the space between the baffle and the interior of the hollow disc means and down between the inlet cooling tube and drive shaft. The top of the disc means over the coolant baffle is formed of copper. A metal rim is placed around the upper outer periphery of the copper disc forming a recessed center portion. A ceramic coating is placed in the recessed portion with its outer edge against the inside of the rim. The metal rim acts to hold the coating against centrifugal force and to provide a material for the liquid metal to melt and form a fusion weld therewith to firmly attach a controlled solidified metal skull to the atomizer.

8 Claims, 3 Drawing Figures

FIG. 1
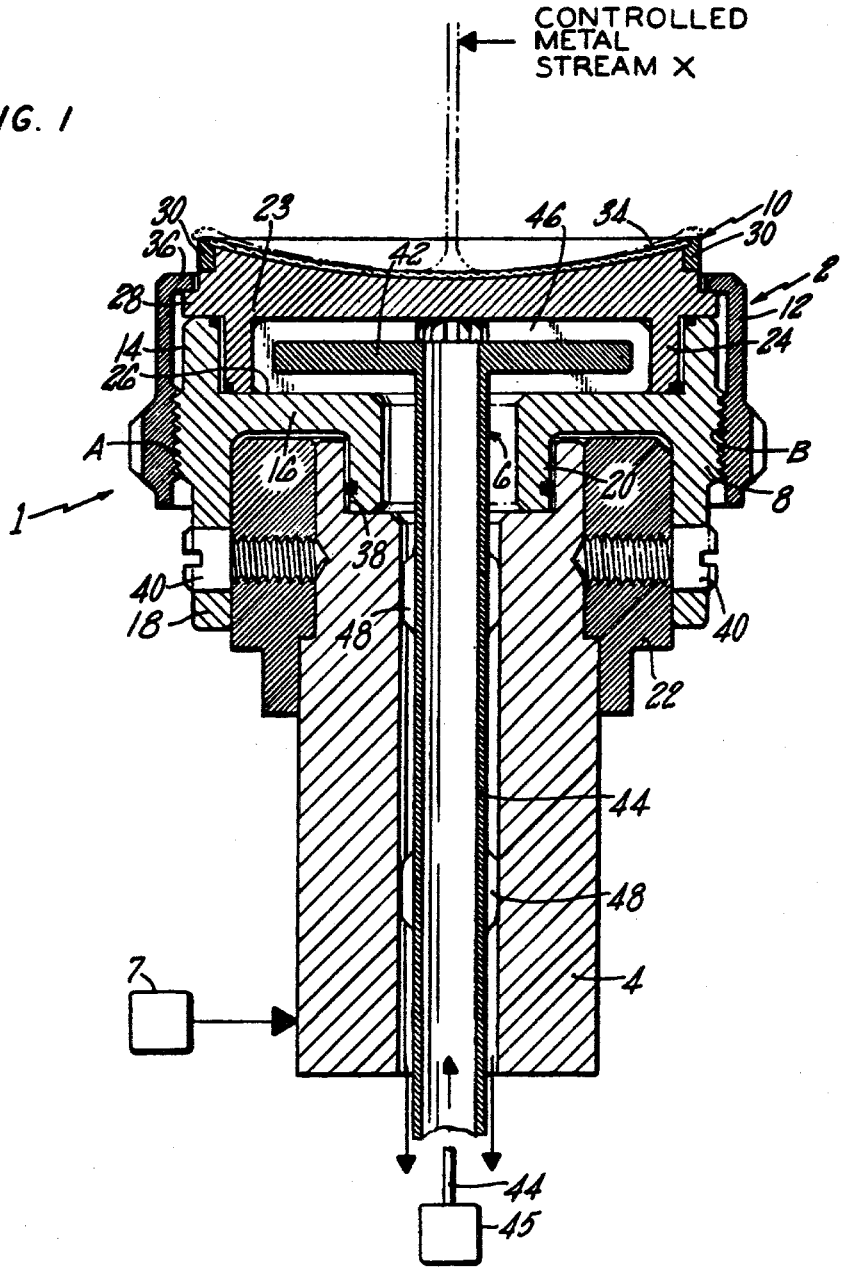
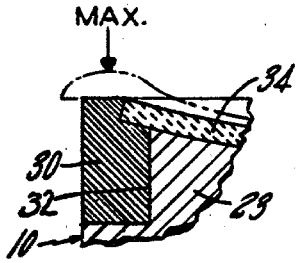
FIG. 2
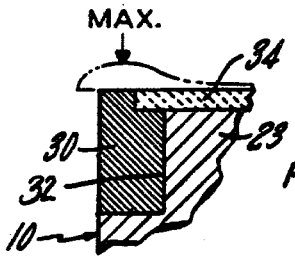
FIG. 3

ROTARY ATOMIZATION MEANS FOR THE PRODUCTION OF METAL POWDER

The invention disclosed herein was made in the performance of or under a contract with the Department of Defense.

CROSS REFERENCE TO RELATED APPLICATIONS

This a division of application Ser. No. 862,898 filed on Dec. 21, 1977.

Application Ser. No. 862,897 to Romeo G. Bourdeau for "Spin Cup Means for the Production of Metal Powder" and Application Ser. No. 862,899 to Charles C. Thompson for "Cooling Means for Metal Atomization Means" are being filed herewith and disclose related arrangements.

BACKGROUND OF THE INVENTION

This invention relates to a rotary liquid metal atomizer for the production of metal powders. This type of atomizer is designed for the production of rapidly quenched metal powders as shown in U.S. Pat. Nos. 4,025,249 and 4,053,264. A further disclosure of an apparatus for using such a metal atomizer, or disc, is set forth in U.S. Application Ser. No. 654,247 and U.S. Application Ser. No. 751,004. Other prior art patents showing various types of rotary atomizing devices are listed below: U.S. Pat. No. 2,062,093; U.S. Pat. No. 2,699,576; U.S. Pat. No. 4,027,718; U.S. Pat. No. 2,271,264; and U.S. Pat. No. 2,439,772.

SUMMARY OF THE INVENTION

According to the present invention, a rotary atomization means is described which will provide a metal powder of desired size and cooling rate.

It is an object of this invention to provide an improved rotary atomization means having a disc means with a top thereof comprising an outer metal ring with an inner ceramic coating. The metal ring contains the inner ceramic coating and supports it against centrifugal force.

It is a further object of this invention to provide a rotary atomization means which is internally cooled by a flowing coolant, said coolant maintaining the atomization means at a temperature below its melting point, and aiding in establishing stable operation of the device.

It is a further object of the invention to control the superheat in the molten liquid and the heat losses during initial operation to establish a stable skull, said skull providing the required surface for wetting and coupling of the liquid metal to the rotating surface for efficient atomization. As the molten metal initially flows to the center of the upper surface of the ceramic coating of the rotary atomization means, it is accelerated outwardly towards the exposed surface of a ring member of relatively low heat conductivity, during this initial contact and while the atomization means is becoming heated by heat from the molten metal, the temperature of the molten metal across the top surface of the atomization means drops to a point where it solidifies and a skull starts to form. The initial heat of the molten metal melts the surface of the ring member and forms a weld to firmly attach the solidified metal skull. The metal skull forms until a higher stable operating temperature is reached permitting the molten metal stream to remain molten as it passes over the already formed controlled metal skull and is thrown radially outwardly from the edge of the atomization means. The formation of the desired solidified metal skull is obtained by controlling the temperature of the molten metal and the temperature of the surface of the atomization means. While the temperature of the molten metal can be controlled by merely heating the metal to a desired temperature, the temperature of the surface of the atomization means is controlled by the construction of the atomization means and the controlled cooling thereof.

BRIEF DESCRIPTION OF THE DRAWINGS

FIG. 1 is sectional view of a liquid metal atomizer attached to the end of a shaft for rotation;

FIG. 2 is an enlarged view of the outer periphery of the liquid metal atomizer showing a stable skull in phantom fixed to a ring on the outer edge thereof; and FIG. 3 is an enlarged view of a modification of a liquid metal atomizer having a flat top surface.

DESCRIPTION OF THE PREFERRED EMBODIMENT

Rotary atomization means 1 are shown for receiving a stream X of molten metal and accelerating it outwardly in an apparatus for making metal powder. Such apparatus is referred to above in the listed patents.

While any type crucible can be used having any controlled means for heating and pouring, such a construction is shown in U.S. Pat. No. 4,025,249 wherein a crucible having an induction furnace associated therewith is pivotally mounted in a movable supporting carriage. Such construction can be used for the pouring of the molten metal referred to in this application and induction control means provided to control the temperature of the molten metal.

This atomization means 1 comprises a disc means 2 fixedly mounted to the top of a drive shaft 4. Drive shaft 4 can be mounted for rotation by any means desired and can be rotated by any one of a known number of means 7, such as by an electric motor, or by an air turbine. For this application, R. P. M.'s over 10,000 are considered high. Cooling means 6 are provided within said disc means 2 and drive shaft 4. The disc means 2 is formed having a lower body portion 8 and a composite upper body member 10. The composite upper body member 10 is fixed to the lower body portion 8 by a large hold-down nut 12.

The lower body portion 8 is formed having a cylindrical member 14 projecting upwardly from the outer periphery of an annular member 16. A cylindrical member 18 also extends downwardly from the outer periphery of said annular member 16. Another short cylindrical member 20 extends downwardly from the inner edge of the annular member 16. The two downwardly extending cylindrical members 18 and 20 form an annular groove which receives the upper end of the drive shaft 4 and adapter member 22, to be hereinafter described.

The composite upper body member 10 is formed having an upper body portion 23 with a downwardly projecting flange 24 which fits within the inner surface of the cylindrical section 14 of the lower body portion 8. Upper body portion 23 is formed of a relatively high thermal conductivity material to maintain its strength under high centrifugal loads. This construction forms a cylindrical space 26 between the upper body portion 23 and the lower body portion 8. A radially extending flange 28 extends outwardly around the outer periphery of the upper body portion 23 with the lower surface thereof contacting the top of the cylindrical section 14 while a shorter top surface is used for a purpose to be hereinafter described.

The top of the upper body portion 23 is formed concave, but could be a flat surface. An outer metal ring member 30 is fixed in a peripheral recess 32 formed around the top of the outer periphery of the upper body portion 23. The top of the ring member 30 extends above the top surface of the upper body portion 23 a distance to accommodate a ceramic coating 34. While a groove 35 is shown around the inner periphery of the ring member 30 to further accommodate the outer edge of the ceramic coating 34, the ring member could be rectangular in cross section with the periphery of the ceramic coating 34 abutting the ring member 30. This is shown in FIG. 3 where a flat surface is formed on the top of the upper body portion 23. The ceramic coating 34 can be a plasma or flame-sprayed coating which serves (1) as an erosion-resistant surface to prevent contamination of the liquid fluids; (2) acts as an insulator to prevent surface metal melting of the atomizer body, and helps limit heat transfer from the liquid metal being atomized; and (3) the porous nature of the coating provides the necessary thermal shock resistance, while the surface porosity also assists in mechanically locking the metal skull to the surface of the atomizer. Any number of different surface coatings may be employed as long as they satisfy the above requirements. A $Mg\ Zr\ O_3$ coating was found to be satisfactory for the atomization of nickel base superalloy liquids. From preliminary tests, coatings of Ca O, stabilized $Zr\ O_2$, and $Al_2\ O_3$ should perform well.

The exposed metal of the ring member 30 on the surface of the upper body member 10 (1) acts as a holder for the ceramic coating 34 which might otherwise fail under high centrifugal loadings; (2) the poured liquid metal which first solidifies to form a surface skull, melts the surface of the metal ring and forms a fusion weld to firmly attach the skull to the rotating atomization means 1; and (3) the ring provides a thermal barrier for the development of the metal skull of a desired thickness. By adjusting the exposed metal rim width on the top surface, its depth and breadth below the surface coating 34 and by selecting the proper metal or alloy of low known thermal conductivity, metal skulls can be developed with desired performance characteristics.

The outer surface of the lower body portion 8 is externally threaded at A to receive the internal threads B of the large hold-down nut 12. The top of the hold-down nut 12 has an inwardly extending annular flange 36 which engages the shorter top surface of the radially extending flange 28 for holding the upper body portion 23 in position against the lower body portion 8. The top of the hollow drive shaft 4 is formed having a recess 38 therein for receiving the downwardly extending short cylindrical section 20. The adapter member 22 is provided to fill the space between the top of the drive shaft 4 and cylindrical member 18. Bolts 40 extend through the cylindrical member 18, adapter member 22 and into the top of the drive shaft 4. This fixes the disc means 2 to the top of the drive shaft 4.

A circular water baffle 42 is positioned in the cylindrical space 26 having a conduit 44 fixed to the center thereof for delivering a cooling fluid through a central opening which extends through the circular coolant baffle 42. Fins 46 extend radially outwardly along the bottom of the circular water baffle 42 from the surface of the conduit 44 upwardly around the outer periphery of the baffle 42 and inwardly along the upper surface to the edge of the opening at the center thereof. This specific construction is shown and claimed in Application Ser. No. 862,899 to Charles C. Thompson, referred to above. The fins 46 properly position the coolant baffle 42 in the cylindrical space 26. If fins are not used, standoff pins can be used to position the baffle 42. Conduit 44 is provided with spacers 48 to properly locate it within the hollow shaft 4. The coolant is pumped upwardly into conduit 44 by a pump 45 around the coolant baffle 42 and down between the conduit 44 and cylindrical member 20 and the interior of the hollow drive shaft 4. The cooling fluid maintains the upper body member 10 at a temperature below its melting point and aids in establishing thermal equilibrium for stable operation of the device. Stability is established after a thin metal skull has formed over the top surface of the ceramic coating and ring member 30.

Experimental runs were made in an apparatus used for making metal powder using a rotary atomization means as set forth herein. The results of three experimental runs are set forth below to aid the reader in understanding how the device performs. Information is given regarding the molten metal atomized, the upper body portion 23, ring member 30, ceramic coating 34, and the solidified metal skull formed.

The results of three experimental powder runs are set forth below:

| RUN 1: | |
|---|---|
| Molten metal atomized: | |
| Temperature: | 2950° F. |
| Flow rate: | 0.325 lbs/sec |
| Material: | IN-100 |
| Upper body portion 23: | |
| Surface: | Flat |
| Diameter: | 3.3 inches (8.38 cm) |
| Rotational speed: | 23700 rpm |
| Material: | Copper |
| Ring member 30: | |
| Exposed width on top surface: | .050 inches (.127 cm) |
| Material: | IN-100 |
| Ceramic coating 34: | |
| Material: | $Mg\ Zr\ O_3$ |
| Thickness: | .020 (.051 cm) |
| Solidified metal skull formed: | |
| Maximum thickness: | 0.130 inches (.33 cm) |

The results of three experimental powder runs are set forth below:

| RUN 2: | |
|---|---|
| Molten metal atomized: | |
| Temperature: | 2950° F. |
| Flow rate: | 0.401 lbs/sec |
| Material: | IN-100 |
| Upper body portion 23: | |
| Surface: | Flat |
| Diameter: | 3.3 inches (8.38 cm) |
| Rotational speed: | 21500 to 25000 rpm |
| Material | Copper |
| Ring member 30: | |
| Exposed width on top surface: | .050 inches (.127 cm) |
| Material: | IN-100 |
| Ceramic coating 34: | |
| Material: | $Mg\ Zr\ O_3$ |
| Thickness: | .049 inches (.124 cm) |

-continued

| RUN 2: | |
|---|---|
| Solidified metal skull formed: | |
| Maximum thickness: | .050 inches (.127 cm) |

The results of three experimental powder runs are set forth below:

| RUN 3: | |
|---|---|
| Molten metal atomized: | |
| Temperature: | 2950° F. |
| Flow rate: | 0.34 lbs/sec |
| Material: | IN-100 |
| Upper body portion 23: | |
| Surface: | Flat |
| Diameter: | 3.3 inches (8.38 cm) |
| Rotational speed: | 24000 rpm |
| Material: | Copper |
| Ring member 30: | |
| Exposed width on top surface: | .025 inches (.0635 cm) |
| Material: | IN-100 |
| Ceramic coating 34: | |
| Material: | Mg Zr $O_3$ |
| Thickness: | .050 inches (1.25 cm) |
| Solidified metal skull formed: | |
| Maximum thickness: | .070 inches (.178 cm) |

We claim:

1. A rotary atomization means for receiving a flow of molten metal on an upper surface for the production of metal powder comprising a drive shaft mounted for rotation, disc means fixedly mounted to the top of the drive shaft, said disc means having an upper metal disc member with a top surface and cylindrical periphery, said upper disc member having a metal ring mounted around the upper periphery thereof, said ring extending above the top surface of said upper disc member forming a recessed center portion, a ceramic layer located in the recessed portion with its outer edge against the inner surface of said ring and its upper surface matching the upper surface of said ring.

2. A rotary atomization means as set forth in claim 1 wherein said disc means has a lower disc member, said lower disc member having a first cylindrical section extending upwardly therefrom, said upper disc member having a second cylindrical section extending downwardly therefrom, said first and second cylindrical sections being sized so that said first cylindrical section fits within said second cylindrical section, a space being formed between said upper disc member and said lower disc member for receiving a flow of cooling fluid, means for fixing said upper disc member to said lower disc member.

3. A rotary atomization means as set forth in claim 1 wherein said upper disc member metal has a high thermal conductivity and said ring metal has a relatively low thermal conductivity.

4. A rotary atomization means as set forth in claim 3 wherein said metal of high thermal conductivity is copper.

5. A rotary atomization means as set forth in claim 3 wherein said metal of low thermal conductivity is the same as the molten metal.

6. A rotary atomization means as set forth in claim 1 wherein said top surface of said disc means is concave.

7. A rotary atomization means as set forth in claim 1 wherein said cylindrical periphery has a recess in the upper part where it meets the top surface, said metal ring being mounted in said recess.

8. A rotary atomization means as set forth in claim 1 wherein said ring and said ceramic layer form a surface for the formation of a controlled solidified metal skull.

* * * * *